US005993604A

United States Patent [19]

Finlayson et al.

[11] Patent Number: 5,993,604

[45] **Date of Patent: *Nov. 30, 1999**

[54] INTERNALLY SIZED ARTICLES AND METHOD FOR MAKING SAME

[75] Inventors: Malcolm F. Finlayson, Houston; Kenneth E. Springs, Clute; John J. Gathers, Pearland; James L. Cooper, Lake Jackson, all of Tex.; Stephen M. Oliver, Wollerau, Switzerland

[73] Assignee: The Dow Chemical Company, Midland, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/687,797

[22] Filed: Jul. 19, 1996

Related U.S. Application Data

[60] Provisional application No. 60/008,209, Dec. 5, 1995.

[51] Int. Cl.[6] ..... D21H 21/16

[52] U.S. Cl. ..... 162/168.1; 162/164.3; 162/164.6; 162/175; 162/183

[58] Field of Search ..... 162/164.3, 164.6, 162/168.1, 183, 175

[56] References Cited

U.S. PATENT DOCUMENTS

| | | | |
|---|---|---|---|
| 2,601,597 | 6/1952 | Daniel et al. | 162/164.3 |
| 2,765,229 | 10/1956 | McLaughlin | 162/168.1 |
| 3,049,469 | 8/1962 | Davison | 162/164.3 |
| 3,389,109 | 6/1968 | Harmon et al. | 260/29.6 |
| 3,436,363 | 4/1969 | Helin | 260/29.6 |
| 3,520,861 | 7/1970 | Thomson et al. | 260/88.1 |
| 3,644,258 | 2/1972 | Moore et al. | 260/29.6 H |
| 3,674,896 | 7/1972 | Purcell et al. | 260/897 B |
| 3,872,039 | 3/1975 | Vaughn et al. | 162/168.1 |
| 3,899,389 | 8/1975 | Vaughn et al. | 162/168.1 |
| 3,919,149 | 11/1975 | Cushman et al. | 260/28.5 AV |
| 3,983,268 | 9/1976 | Scharf et al. | 427/341 |
| 4,070,319 | 1/1978 | Carel et al. | 260/29.4 UA |
| 4,173,669 | 11/1979 | Ashida et al. | 428/35 |
| 4,181,566 | 1/1980 | Vaughn et al. | 162/164.3 |
| 4,400,440 | 8/1983 | Shaw | 428/511 |
| 4,440,908 | 4/1984 | McClain | 525/196 |
| 4,599,392 | 7/1986 | McKinney et al. | 526/318.6 |
| 4,729,928 | 3/1988 | Schiappa et al. | 428/514 |
| 4,835,212 | 5/1989 | Degen et al. | 524/734 |
| 4,859,527 | 8/1989 | DiStefano | 428/288 |
| 4,988,781 | 1/1991 | McKinney et al. | 526/68 |
| 5,082,697 | 1/1992 | Patton et al. | 427/340 |
| 5,160,484 | 11/1992 | Nikoloff | 427/439 |
| 5,206,279 | 4/1993 | Rowland et al. | 524/379 |
| 5,271,990 | 12/1993 | Kronzer et al. | 428/195 |
| 5,336,528 | 8/1994 | Bohme | 427/361 |
| 5,358,790 | 10/1994 | Rüf et al. | 428/486 |
| 5,362,573 | 11/1994 | Pandian et al. | 428/511 |
| 5,384,373 | 1/1995 | McKinney et al. | 526/212 |
| 5,387,635 | 2/1995 | Rowland et al. | 524/379 |
| 5,460,645 | 10/1995 | Pandian et al. | 106/194 |

FOREIGN PATENT DOCUMENTS 0 171 670 A1 2/1986 European Pat. Off. .

OTHER PUBLICATIONS

Koethe et al, "Polyelectrolyte interactions with papermaking fibers: the mechanism of surface–charge decay", *TAPPI Journ.* vol. 76, No. 12 (1993) pp. 123–133.

Derwent 92–296371, JP 4204746, Jul. 27, 1992, See abstract.

Derwent 90–159202/21, JP–251679, (Apr. 11, 1990).

Derwent 84–039664/07, JP–111315, (Jan. 7, 1984).

Derwent 89–166473/23, DE–739641, (Jun. 1, 1989).

Derwent 85–178168/30, DE–400125, (Jul. 18, 1985).

Derwent 52605X/28, JA–149163, (Jul. 1, 1976).

*Primary Examiner*—Peter Chin

[57] ABSTRACT

The present pertains to an improved method of internally sizing a cellulosic article and an improved internally sized cellulosic article where a water-dispersible, water- and alkali-insoluble internal sizing agent from an interpolymer of an ethylenically unsaturated hydrocarbon monomer and an ethylenically unsaturated carboxylic acid comonomer is applied to fiber stock or pulp slurry some amount of time subsequent to the instance of application of a retention aid. The invention also includes a novel internal sizing composition where the interpolymer is rendered water-dispersible by reaction with an inorganic neutralizing cationic compound. The improved method is particularly well suited for paper making wherein substantially improved sizing performance is obtainable. Internal sizing agents based on inorganic neutralizing cationic compounds such as, for example, potassium hydroxide, provide the surprising advantage of hard water resistance.

15 Claims, 2 Drawing Sheets

INTERNALLY SIZED ARTICLES AND METHOD FOR MAKING SAME

CROSS-REFERENCE TO RELATED APPLICATIONS

This application is related to provisional application U.S. Ser. No. 60/008209, filed Dec. 5, 1995, in the names of M. F. Finlayson, K. E. Springs, J. J. Gathers, J. L. Cooper, S. Oliver and W. L. Vaughn, the disclosure of which is incorporated herein by reference.

FIELD OF THE INVENTION

The present invention relates to a method of internally sizing a cellulosic article and to an internally sized cellulosic article wherein the sizing agent is based on an interpolymer of an ethylenically unsaturated hydrocarbon monomer and at least one ethylenically unsaturated carboxylic acid comonomer. The invention particularly pertains to, and is particularly adaptable to, a method of making internally sized paper and to internally sizing paper wherein the sizing agent is based on an ethylene/acrylic acid (EAA) interpolymer.

BACKGROUND OF THE INVENTION

Sizing is the process of providing cellulosic articles such as, for example, paper and paper board with resistance to penetration by liquids. Sizing may be accomplished via an internal sizing process, an external sizing process, or as in the usual case, a combination of both.

The processes of internal sizing and external sizing are very different from each other in many respects. For internal sizing, sizing is initiated before the cellulosic article is completely formed. Internal sizing usually is accomplished by adding an internal sizing agent, in conjunction with a retention aid, directly to an aqueous pulp slurry wherein the sizing agent coats the fibers of the pulp. Internal sizing agents are generally hydrophobic in nature wherein their nonpolar portions are anchored to the surface of fibers and thereby retard water penetration when the fibers are completely formed or fabricated into the finished cellulosic article. See, Biermann, C. J., *Essentials of Pulping and Papermaking*, Academic Press, Inc., 1993, p.197.

External sizing is also referred to in the art as surface, tub, or calender sizing. For external sizing, sizing agents are applied to one or both surfaces of a completely formed cellulosic article, generally without the addition of retention aids. In contrast to the hydrophobic materials required for internal sizing, non-hydrophobic materials, such as, starch, are commonly used as external sizing materials. Whereas, internal sizing takes place on surface of pulp fibers in a slurry, external sizing occurs when an external sizing material is applied to the surface of a fabricated cellulosic article and fills the capillaries of the article, rendering water penetration more difficult.

For internal sizing of paper, Vaughn et al. in U.S. Pat. Nos. 3,872,039; 3,899,389; and 4,181,566, described the combination of an ammoniated copolymer of ethylene and an ethylenically unsaturated carboxylic acid and a cationic retention aid. The advantage of the sizing systems disclosed by Vaughn et al was said to be their utility over the complete range of pH conditions found in paper-making operations. For these systems, Vaughn et al. taught the order of addition of the sizing agent and the retention aid to a conventional paper making process was not critical. Nevertheless, Vaughn et al. preferred to add the sizing agent prior to the addition of the retention aid.

Rowland et al. in U.S. Pat. Nos. 5,206,279 and 5,387,635 disclosed aqueous dispersions of copolymer of ethylene and an ethylenically unsaturated carboxylic acid. Rowland et al. described the combination of two bases, one as a weak cation and the other as a strong cation, that was said to permit the preparation of stable dispersions of copolymers having relatively low carboxylic acid concentrations (e.g. less than 15 weight percent acrylic acid content).

While there are variety of known sizing systems, there is still a need for a wet-end internal sizing system that provides improved cellulosic sizing performance, i.e., higher Hercules Size Test (HST) values at 80 percent reflectance as measured in accordance with TAPPI method T 530 pm-89. Higher HST values translate into improved hydrophobicity and water penetration resistance. There is also a need for a sizing system that permits the use of various retention aids. For example, sizing operators desire the versatility of being able to use retention aids that provide good wet strength (e.g., Kymene 557) on some occasions and, on other occasions, employing retention aids that do not provide good wet strength (e.g., Nalco 7583). There is also the need to provide a sizing system wherein the sizing agent is stable and resistant to precipitation from hard water dilutions and yet is easily repulpable when, for example, operators desire cellulosic articles and substrates with enhanced wetting characteristics. There is also the need to provide a sizing system that has improved receptivity to various fillers without disturbing the basic sizing performance of the system.

SUMMARY OF THE INVENTION

An improved method of internally sizing a cellulosic article, particularly paper, and an improved internally sized cellulosic article have now been discovered. In the method for internally sizing a cellulosic article, at least one internal sizing agent and at least one retention aid are applied to the fibers of the cellulosic article. The internal sizing agent is a water-dispersible, water- and alkali-insoluble interpolymer of an ethylenically unsaturated hydrocarbon monomer and at least one ethylenically unsaturated carboxylic acid comonomer. The improvement comprises applying the at least one retention aid to the fibers prior to the application of the at least one internal sizing agent.

Another aspect of the present invention is in a method for internally sizing a cellulosic article wherein at least one internal sizing agent and at least one retention aid are applied to the fibers of the cellulosic article and the at least one internal sizing agent is a water-dispersible, water- and alkali-insoluble reaction product of at least one neutralizing cationic compound and at least one interpolymer of ethylenically unsaturated hydrocarbon monomer and at least one ethylenically unsaturated carboxylic acid comonomer. The improvement comprises employing an inorganic cationic compound as the at least one neutralizing cationic compound.

Another aspect of the present invention is an internally sizing composition comprising (A) a water-dispersible, water- and alkali-insoluble reaction product of
  (1) at least one inorganic neutralizing cationic compound and
  (2) at least one interpolymer of ethylenically unsaturated hydrocarbon monomer and at least one ethylenically unsaturated carboxylic acid comonomer, and (B) at least one retention aid.

Another aspect of the present invention is an internally sized cellulosic article comprising a sizing amount of a water-dispersible, water- and alkali-insoluble reaction product of at least one inorganic neutralizing cationic compound and at least one interpolymer of ethylenically unsaturated hydrocarbon monomer and at least one ethylenically unsaturated carboxylic acid comonomer and an amount of at least one retention aid effective to retain the reaction product or interpolymer on the fibers of the cellulosic article.

In addition to size, the resulting cellulosic has excellent tensile strength, printability, brightness, surface smoothness, and gloss. An advantage of employing at least one retention aid prior to the introduction of the water-dispersible, water- and alkali-insoluble sizing agent is less sizing agent will be required to achieve equivalent sizing performance. An advantage of employing inorganic neutralizing cationic compounds (rather than, for example, organic ammoniated systems) to render the sizing interpolymer water-dispersible and water- and alkali-insoluble is resultant dispersions will be less sensitive to dilutions with hard water such as, for example, ordinary tap water.

DETAILED DESCRIPTION OF THE INVENTION

Figure 1:
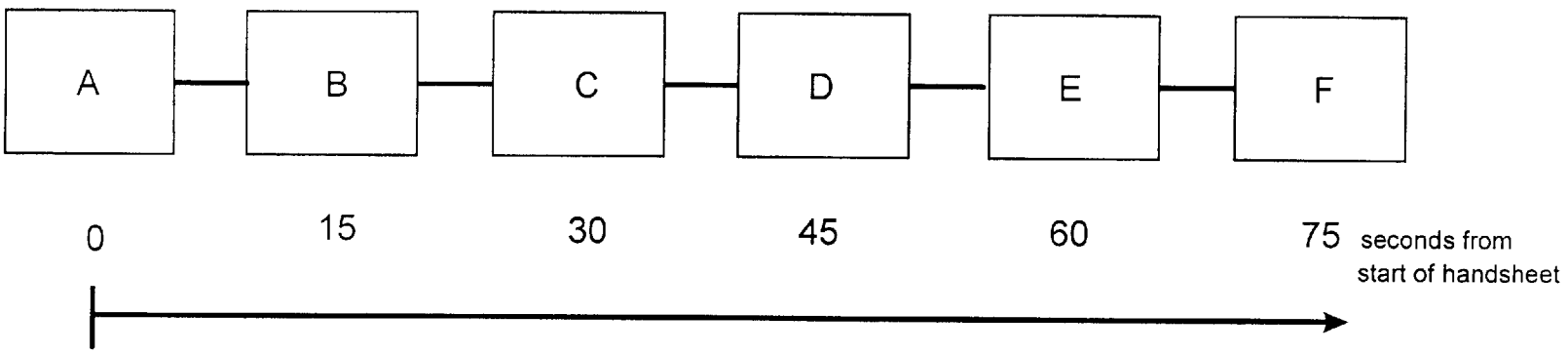
FIG. 1 is a time sequence schematic of a handsheet paper making procedure wherein various addition times/points are shown.

The term "internal sizing" as used herein refers to a method of sizing in which a sizing material is contacted with cellulosic fiber and/or pulp under conditions effective to size the resultant cellulosic material, i.e., deposit the sizing agent on the fibers and/or pulp and increase the cellulosic article's hydrophobicity as measured by the Hercules Size Test, TAPPI method T 530 pm-89. The sizing performance or characteristics of the cellulosic article may be generally controlled by the amount of water-dispersible, water- and alkali-insoluble reaction product (i.e., the sizing agent) employed.

In general, the higher the HST value, the better the hydrophobicity and water resistance. In the present invention, effective sizing will constitute a HST value greater than 1, preferably greater than about 100, more preferably greater than about 400 and most preferably greater than about 700.

The internal sizing agents suitably employed in the practice of this invention are neutralized interpolymers of an ethylenically unsaturated hydrocarbon monomer and at least one ethylenically unsaturated carboxylic acid comonomer. These interpolymers are generally solid or semi-solid, often in the form of pellets, and water-dispersible when sufficiently neutralized with a base. The term "reaction product" as used herein refers to an ionic interaction or an ion exchange reaction between the interpolymer and a cationic compound. The term "water-dispersible" as used herein refers to a material which can exist in the form of a stable aqueous colloidal dispersion in the absence of a surface active agent or surfactants and includes both the pre-dispersed and dispersed forms. The term "water-dispersible" does not necessarily mean the material has already been dispersed in an aqueous media. The term "water-dispersible interpolymer" includes interpolymers that require and do not require neutralization or base interaction to be rendered dispersible in aqueous media. The term "ethylenically unsaturated monomer" as used herein refers to hydrocarbon monomers containing a terminal double bond capable of polymerization under normal conditions of free-radical addition polymerization to form a water-insoluble homopolymer having a polyethylenic backbone. The term "ethylenically unsaturated carboxylic acid comonomer" is used herein to refer to a comonomer containing alpha-beta unsaturation and carboxylic acid groups and which is capable of free-radical addition interpolymerization through the ethylenically unsaturated group with ethylenically unsaturated monomers.

The internal sizing agent is a normally solid, water-insoluble and alkali-insoluble thermoplastic addition interpolymer in the form of an aqueous colloidal dispersion. The carboxylic acid groups of the interpolymer should be neutralized with a base such as, for example, ammonia, alkali metal hydroxides, alkaline earth metal hydroxides, or mixtures thereof to form active salt groups. This is normally accomplished by dispersing the interpolymer in aqueous solutions of the above bases or mixtures thereof to form a basic aqueous dispersion of interpolymer. However, it is understood that an ethylenically unsaturated carboxylic acid comonomer in active salt form may be interpolymerized with an ethylenically unsaturated monomer in order to prepare a suitable interpolymer having active salt groups. In any event, the occurrence of active salt groups formed on the interpolymer should be general throughout the macromolecules thereof so that each macromolecule contains a minimum number of active salt groups sufficient to render the polymer water-dispersible as defined hereinbefore. The maximum number of acid groups which have been converted into active salt groups that may be present in the macromolecules is fixed by the requirement that the dispersed polymer particles be substantially water-insoluble although the original unneutralized interpolymer can be water soluble. Generally speaking, such interpolymers contain from about 1 to about 99 weight percent carboxylic acid comonomer, with preferred interpolymers containing from about 6 to about 40 weight percent carboxylic acid comonomer and especially preferred interpolymers containing from about 10 to about 25 weight percent carboxylic acid comonomer.

Exemplary preferred interpolymers are the random copolymer products of interpolymerization of mixtures of (1) one or more polymerizable ethylenically unsaturated carboxylic acid comonomers having 3 to 8 carbon atoms, inclusive of anhydrides and alkyl esters and half esters, such as acrylic acid, methacrylic acid, maleic acid and anhydride, itaconic acid, fumaric acid, crotonic acid and citraconic acid and anhydride, methyl hydrogen maleate, ethyl hydrogen maleate, with acrylic acid and methacrylic acid being particularly preferred and (2) one or more ethylenically unsaturated hydrocarbon monomers such as aliphatic olefin monomers, e.g., ethylene, propylene, butene-1 and isobutene; conjugated dienes, e.g., butadiene and isoprene; and monovinylidene aromatic carbocyclic monomers, e.g., styrene, methylstyrene, toluene, and t-butylstyrene.

In addition, other ethylenically unsaturated comonomers which are not entirely carboxylic acids can interpolymerized with the aforementioned ethylenically unsaturated hydrocarbon monomer. Examples of such suitable comonomers which are not entirely carboxylic acids include esters of ethylenically unsaturated carboxylic acids such as ethyl acrylate, methyl methacrylate, ethyl methacrylate, methyl acrylate, isobutyl acrylate, and methyl fumarate; unsaturated esters of non-polymerizable carboxylic acids such as vinyl acetate, vinyl propionate, and vinyl benzoate; vinyl halides such as vinyl and vinylidene chloride; vinyl ethers; ethylenically unsaturated amides and nitriles such as acrylamide, acrylonitrile, methacrylonitrile and fumaronitrile. It is understood that the aforementioned suitable comonomers may be interpolymerized with a preferred hydrocarbon monomer and a carboxylic acid comonomer in proportions such that a water- and alkali-insoluble polymer is provided.

Preferred interpolymers include interpolymers from about 70 to about 90 weight percent of ethylene, from about 10 to about 20 weight percent of one or more ethylenically unsaturated carboxylic acid, such as acrylic acid and methacrylic acid, in active salt form and from 0 to about 20 weight percent of suitable ethylenically unsaturated monomer as described hereinbefore such as acrylonitrile, ethyl acrylate and vinyl acetate. The above interpolymers may be made according to the methods and procedures described in U.S. Pat. Nos. 3,436,363; 3,520,861; 4,599,392; and 4,988,781.

Other suitable interpolymers are made from pre-formed, non-acid polymers by subsequent chemical reactions carried out thereon. For example, the carboxylic acid group may be supplied by grafting a monomer such as acrylic acid or maleic acid onto a polymer substrate such as polyethylene. Additionally, interpolymers containing carboxylic anhydride, ester, amide, acylhalide and nitrile groups can be hydrolyzed to carboxylic acid groups which can then be neutralized to form the activated salt forms of carboxylic acid.

The basic aqueous dispersion of interpolymer should contain an amount of solid interpolymer such that cellulose sizes after application of the dispersion to the fiber or pulp. This amount varies depending upon the particular interpolymer employed as well as other conditions of the cellulosic processing such as the bases employed in the dispersion and type of cellulosic being produced. Generally, the amount of solid interpolymer in the dispersion should be at least that which will be retained and impart hydrophobicity upon application to the cellulosic. That is, the dispersion percent solids should be greater than about 1, preferably greater than about 10, more preferably greater than about 20 and most preferably greater than about 40, or alternatively, in the range of from about 1 to about 90 percent, preferably from about 10 to about 80 percent, more preferably about 20 to about 70 percent and most preferably from about 40 to about 80 percent. On the other hand, the amount of solids interpolymer in the dispersion should not be so high that the dispersion is too viscous to be applied or poor mixing results when the dispersion is introduced.

In the present invention, degree of sizing obtained is controlled by the amount of solid interpolymer that is retained on the cellulosic. For instance, a greater amount of solid interpolymer retained on the cellulosic typically results in a greater degree of sizing. Correspondingly, if a lesser amount of solid interpolymer is retained, then a lesser degree of sizing results. Therefore, although other means can be employed to control the degree of sizing, the most convenient is to adjust the solids concentration of interpolymer in the dispersion being applied to the cellulosic. However, for effective sizing, the amount of solid interpolymer in grams per ton of cellulose should be greater than about 100, preferably greater than about 900, more preferably greater than 2000 and most preferably for superior hydrophobicity greater than about 10,000.

The amount of sizing agent present in process waters or retained on the cellulose can be determined by conventional analytical method and procedures. See, for example, the disclosure by L. Zlatkevich in *Luminescence Techniques in Solid State Polymer Research*, ed., Marcel Dekker Inc, (1989), the disclosure of which is incorporated herein by reference. One suitable analytical procedure includes tagging the sizing agent with ruthenium tris bipyridine and quantification using inductive coupled plasma mass spectrometry or luminescence spectroscopy.

In the present invention, aqueous dispersions of the above interpolymers may utilize organic or inorganic bases as neutralizing cationic compounds and be prepared by any conventional procedure. Suitable neutralizing cationic compounds include, but are not limited to, ammonia, alkali metal hydroxides, alkaline earth metal hydroxides or mixtures thereof. Dispersions of the interpolymer in aqueous ammonia to neutralize the carboxylic acid groups can be made according to methods and procedures described in U.S. Pat. Nos. 3,389,109; 3,872,039; 3,899,389; and 4,181,566. Dispersions of alkali metal hydroxides, alkaline earth metal hydroxides and mixtures with ammonia may suitably be made according to the methods and procedures described in U.S. Pat. Nos. 5,206,279 and 5,387,635. In certain embodiments of the present invention, dispersible interpolymers will utilize inorganic cationic compounds and combinations of an inorganic cationic compound and an organic cationic compound. Preferred inorganic cationic compounds include, but are not limited to, sodium and potassium metal salts such as, for example, sodium hydroxide and potassium hydroxide, and potassium hydroxide is particularly preferred as the only neutralizing cationic compound or in combination with an organic cationic compound such as, for example, ammonium hydroxide.

Suitable retention aids for use in the present invention are contemplated to include, but are not limited to, long chain fatty amines; polyamines; polyacrylamines; polyacrylamides; polyimines;copolymers of ethylenimine with various monomers; polydimethyl diammonium chloride; chromic sulfate; sodium alumate; aluminum sulfates; animal glue; reaction products of dibasic caboxylic acids, polyalkylene polyamines and epihalohydrins; reaction products of epihalohydrin and ammonia; reaction products of epihalohydrin and primary, secondary or tertiary amines; reaction products of epihalohydrin and aliphatic polyamine; reaction products of epihalohydrin and a mixture of ammonia and an aliphatic polyamine and reaction products of epihalohydrin and a mixture of ammonia and a primary, secondary or tertiary amine.

Representative retention aids for use as the first retention aid in the present invention include Kymene 557 and Reten 201, commercially available from Hercules Corporation; Percol 292, commercially available from Allied Colloids, Inc.; and Nalco 7607 and Nalco 7583, commercially available from Nalco Chemical Company. Preferably, the first retention aid is a reaction product of an epihalohydrin and a higher homolog of ethylamine such as, for example, Kymene 557.

In a process for making a cellulosic article as such, for example, in a paper making process, internal sizing agents as aqueous dispersions of an interpolymer of an ethylenically unsaturated hydrocarbon monomer and an ethylenically unsaturated carboxylic acid comonomer are to be applied to the cellulosic fibers and pulp after the application or introduction of a retention aid. A second retention aid can be add after or simultaneously with the sizing agent. A particularly preferred material for additions simultaneously with the sizing agent is a quaternary ammonium cationic starch derivative such as, for example, Stalock 400 available from A. E. Staley Manufacturing Company and Solvatose N available from Avebe Ltd. (Sweden). Other cationic compounds useful for simultaneous additions with the sizing agent include primary, secondary and tertiary amine cationic starch derivatives and other cationic nitrogen substituted starch derivatives as well as cationic sulfonium and phosphonium starch derivatives. A person with ordinary skill in the art will appreciate that starches and starch derivatives should be employed as gelatins; as such, pre-cooking (e.g., 1 hour at 90–95° C.) may be required prior use although some starches are commercially available already gelatinized.

By the term "simultaneous addition," it is meant that the sizing agent and a second retention aid such as, for example, a cationic starch, is added to fiber stock or pulp slurry at the same instance as practicable; however, the term "simultaneous addition" is exclusive of premixing an aqueous dispersion of the sizing agent with a second retention aid prior to introduction to the fiber stock or pulp slurry.

The sizing agent is to applied to the fibers or pulp (or introduced into the process flow stream) at some time subsequent to the addition of the first retention aid. The sizing agent addition time should be equal to or greater than about 0.1 second (s), preferably equal to or greater than about 1 s, more preferably equal to or greater than about 10 s and most preferably equal to or greater than about 15 s after the introduction of the first retention aid. However, the addition of the first retention aid and the sizing agent should preferably be completed before later stages of the process or before the later stages the treatment phase of the process.

Figure 2:
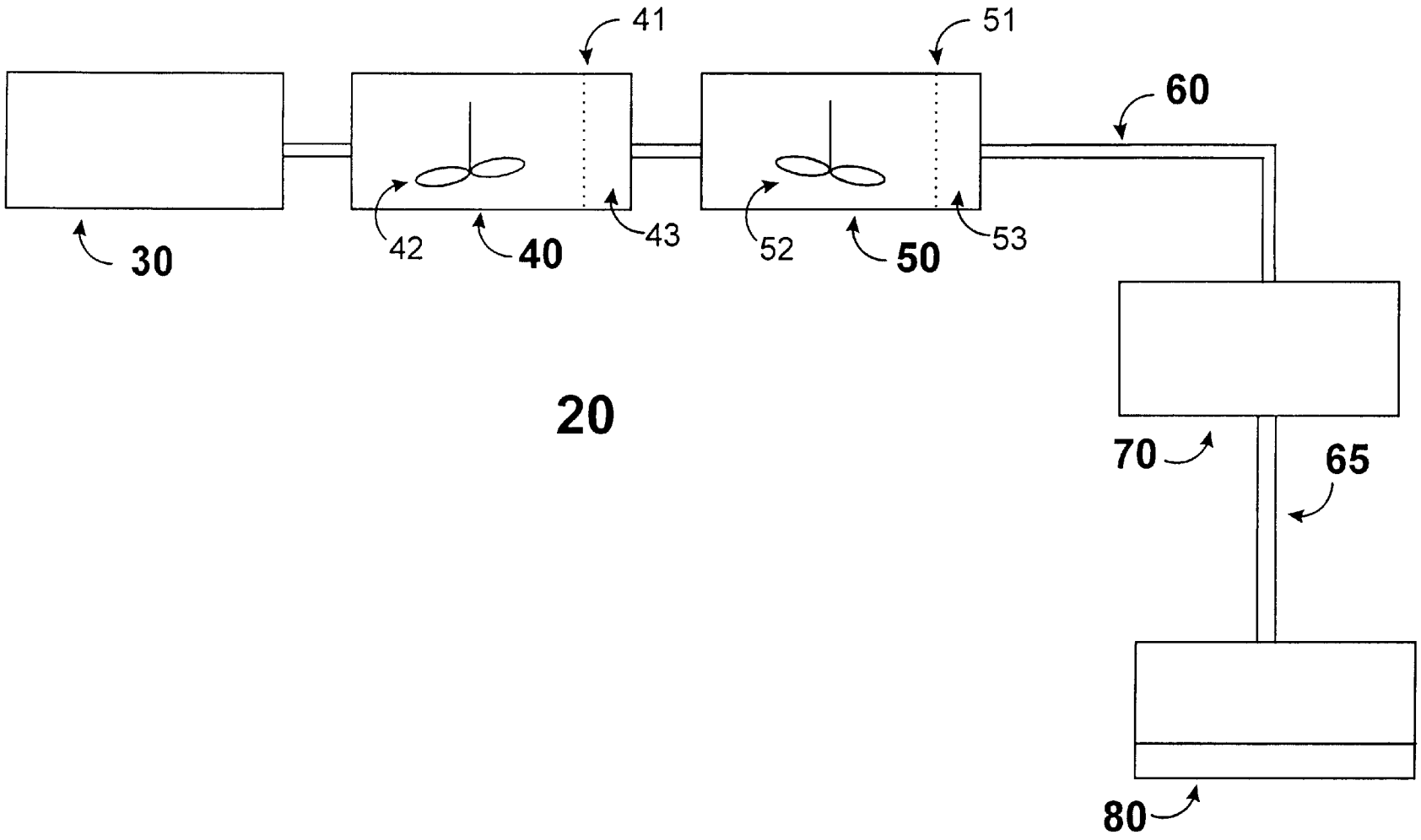
FIG. 2 is a block schematic of the wet-end of a typical paper making process.

As a specific embodiment of the present invention, in a paper making process constructed, for example, as illustrated in FIG. 2 (which is not to scale) and having an average process flow rate from the introduction of the thick stock to through the fan pump and on to the headbox of 20 gallons per minute and where the first retention aid is applied to the fibers or pulp at an addition time of 39 seconds before the headbox, the sizing agent is applied to the fibers or pulp at an addition time of 26 seconds before the headbox (i.e., the sizing agent is applied 13 seconds after the application of the first retention aid). In this embodiment, the introduction of the sizing agent corresponds to an addition time-rate of about 0.65 s/gpm after the first retention aid addition.

The actual addition to the fibers or pulp may take place at any point in the cellulosic article manufacturing process prior to the ultimate conversion of wet-fibrous material into web, sheet or molded article as long as the sizing agent is applied, added or introduced at some time subsequent to the application, addition or introduction of the first retention aid. Thus, in a conventional paper making process such illustrated in FIG. 2, the addition of one or both of the first retention aid and the sizing agent may take place before the headbox, in the headbox, the beater, the hydropulper and/or the stock chest or stuff box as long as the sizing agent is added, applied or introduced some amount of time subsequent to the addition, application or introduction of the first retention aid. Preferably, in a process for making a cellulosic article such as the paper making process illustrated in FIG. 2, the additions or introductions of the first retention aid and the sizing agent is complete before the headbox or flowbox and occur after the stock chest or stuff box.

In order to obtain the objects of the present invention, it is desirable that the sizing agent be uniformly dispersed throughout the fiber in as small a particle size as it is possible to obtain. One method for providing uniform dispersions is to disperse the water-dispersible interpolymer in aqueous media and dilute the resultant dispersion prior to its addition to fiber stock or pulp. While it is generally desirable to use the water-dispersible interpolymer sizing agent as a dilute aqueous colloidal dispersion that is free of emulsifiers and surfactants, such ingredients can be suitably employed in the practice of the present invention as long as such do not impair the effectiveness of the interpolymer sizing agent.

The sizing agents of the present invention can be successfully utilized for the internal sizing of paper and paper products prepared from all types of both cellulosic fibers and combinations of cellulosic fibers and non-cellulosic materials. A suitable example of a non-cellulosic material that may be combined with cellulosic materials is post-consumer recycled plastics. The cellulosic fibers which may be most advantageously used in the present invention are wood pulp fibers and include, but are not limited to, bleached and unbleached sulfate (kraft), bleached and unbleached sulfite, bleached and unbleached soda, neutral sulfite, semi-chemical, chemi-ground wood, ground wood and any combination of these wood pulp fibers.

Additives may be applied to the cellulosic to modify the final properties of the paper, e.g. increase the strength, so long as the additives do not nullify the sizing effect of the interpolymer. Such additives may include fillers, stabilizers, pigments, flocculants, microparticulates, wet and dry strength additives, defoamers, etc. Such additives can often be added directly to the dispersion or compound into the interpolymer before reaction with a neutralizing cationic compound. That is, such additives are not critical to the present invention.

Some additives may be conveniently added to the fiber stock or pulp slurry, e.g. non-cellulosic fillers such as calcium carbonate and clays and a second retention aid without negating the internal sizing effect of the present invention. One additional advantage of the present invention is the high filler receptivity observed for sizing agents based on inorganic cation neutralizing materials, especially potassium metal salts.

EXAMPLES

A D-optimal screening design experiment was conducted using handsheet paper preparations to determine the effect of introducing a first retention aid simultaneous with a sizing agent, before or after the introduction of a sizing agent and introductions early or late in the process before the fiber stock is placed into a mold. The handsheet samples were prepared in accordance with TAPPI Standard T205 om 88 and T402 om 93. The Addition Times/Points for various ingredients are illustrated in FIG. 1 wherein a 0 and 15 second Addition Time/Point was utilized for the first retention aid and the sizing agent. Table 1 shows the details as to retention aid type, addition time/point and concentrations, EAA sizing agent addition time/point, resin type, concentration and mole ratio for the aqueous dispersions as well as addition times/points for a cationic starch, flocculant and microparticulate and the resulting HST values for each sample run.

Aqueous dispersions of three different EAA resins (i.e., a 20% AA, 1300 MI EAA resin; a 15% AA, 1950 MI EAA resin and a 20% AA, 3000 MI EAA resin, all of which are available from The Dow Chemical Company under the designation XU-60751.18) were made in a one gallon Parr reactor which was configured to allow the dispersions to be prepared at temperatures greater than about 100° C. and elevated pressures. In accordance with the screening design, to make a 35 percent solids dispersion, a sufficient amount of the 20% AA, 1300 MI EAA resin was added to either a 0.42 or 0.37 base to acrylic acid mole ratio solution of either ammonium hydroxide ($NH_4OH$) or potassium hydroxide (KOH) respectively, already charged to the reactor and under agitation. Also in accordance with the screening design, to provide a 35 percent solids dispersion, a sufficient amount of the 20% AA, 3000 MI EAA resin was added to either a 0.42 or 0.37 base to acrylic acid mole ratio solution of either ammonium hydroxide ($NH_4OH$) or potassium hydroxide (KOH), respectively, already charged to the reactor and under agitation. For the 15% AA, 1950 MI EAA resin, to make a 25 percent solids dispersion in accordance with the screening design, a sufficient amount of the resin was added to either a 0.7:0.5:1 ammonium to potassium to acrylic acid mole ratio solution already charged to in the reactor and under agitation. The mixed cations were provided by ammonium hydroxide and potassium hydroxide solutions. For each dispersion preparation, agitation was provided by a magnetically coupled stirrer with two six blade (45° pitched) impellers set at 300 revolutions per minute. A Watlow temperature controller ramped the temperature of the reactor from ambient to 105° C. in 30 minutes, maintained the temperature at 105° C. for 45 minutes, then cooled the reactor to ambient temperature. To insure reactor integrity remained intact during the runs, the reactor was pressured with 20 pounds per square inch gauge (psig) of nitrogen at the beginning of each run. After a run was completed, the reactor pressure was checked and each run had returned to original settings. The resulting EAA dispersions were diluted to percent solids concentrations as specified in Table 1 for use as internal sizing agents.

Table 2 provides the average HST values for four groupings of the data derived from the factorially designed experiment. Series One grouping pertains to those sample runs where the first retention aid and the sizing agent were added simultaneously and early in the handsheet procedure (i.e., at time 0 seconds). Series Four grouping pertains to those sample runs where the first retention aid and the sizing agent were added simultaneously and late in the handsheet procedure (i.e., at time 15 seconds). Series Two grouping pertains to those sample runs where the first retention aid was added to the fiber stock after the addition of the sizing agent. Inventive Series Three grouping pertains to those sample runs where the first retention aid was added to the fiber stock before the addition of the sizing agent. Table 2 indicates that Series One and Two groupings gave equivalent results and that the Inventive Series 3 grouping was about 87% higher than the Series Four grouping and about 44% higher than the Series One and Two groupings. These results demonstrate that in a process for making a cellulosic article, substantially improved printability and hydrophobicity are obtained when the sizing agent is introduced after the first retention aid and the earlier in the process both are introduced, the better the performance.

It is noteworthy that the above groupings were made irrespective of true statistical variance; that is, although several variables were changed as part of the design experiment, the groupings were made based only on the relationship between retention aid and sizing aid introductions. However, statistical analysis of the data will yield results consistent with the results supported by the groupings.

TABLE 1

| | EAA MI g/10 min. | Wt. % AA | Cation Type | Mole Ratio (base to AA) | EAA Addition time (sec) | EAA lbs/ton cellulose | Grams of EAA Dispersion | First Retention Aid Type | First Retention Aid Addition time (sec) | First Retention Aid Conc. | Grams of First Retention Aid | Cationic Starch Addition Time | Cationic Starch Conc. | Grams of Cationic Starch | Micro Part | % Solids Retention Aid | HST |
|---|---|---|---|---|---|---|---|---|---|---|---|---|---|---|---|---|---|
| Example | | | | | | | | | | | | | | | | | |
| 1* | 1300 | 20 | K | 0.42 | 15 | 10 | 5 | 7583 | 0 | 10 | 16.7 | 15 | 10 | 2.5 | 1 | 0.15 | 519 |
| 2 | 3000 | 20 | NH3 | 0.42 | 0 | 2 | 1 | 7583 | 15 | 10 | 16.7 | 0 | 10 | 2.5 | 0 | 0.15 | 3 |
| 3* | 1300 | 20 | NH3 | 0.42 | 15 | 2 | 1 | 557 | 0 | 10 | 20.5 | 15 | 30 | 7.5 | 1 | 0.122 | 16 |
| 4 | 3000 | 20 | NH3 | 0.37 | 0 | 10 | 5 | 557 | 15 | 10 | 20.5 | 0 | 30 | 7.5 | 0 | 0.122 | 39.5 |
| 5* | 3000 | 20 | K | 0.42 | 15 | 10 | 5 | 557 | 0 | 2 | 4.1 | 0 | 10 | 2.5 | 0 | 0.122 | 14 |
| 6 | 1300 | 20 | NH3 | 0.37 | 15 | 10 | 5 | 7583 | 15 | 2 | 3.3 | 0 | 30 | 7.5 | 0 | 0.15 | 84 |
| 7 | 1300 | 20 | NH3 | 0.37 | 15 | 10 | 5 | 7607 | 15 | 10 | 5.6 | 15 | 10 | 2.5 | 0 | 0.45 | 137 |
| 8 | 3000 | 15 | K | 0.42 | 0 | 10 | 5 | 7607 | 0 | 10 | 5.6 | 0 | 30 | 7.5 | 1 | 0.45 | 69 |
| 9 | 1300 | 20 | K | 0.42 | 0 | 10 | 5 | 557 | 0 | 2 | 4.1 | 15 | 30 | 7.5 | 0 | 0.122 | 11 |
| 10 | 3000 | 20 | K | 0.42 | 0 | 2 | 1 | 557 | 15 | 2 | 4.1 | 15 | 30 | 7.5 | 0 | 0.122 | 4 |
| 11 | 3000 | 20 | K | 0.42 | 15 | 2 | 1 | 7607 | 15 | 2 | 1.1 | 0 | 30 | 7.5 | 1 | 0.45 | 5 |
| 12 | 3000 | 20 | NH3 | 0.37 | 0 | 2 | 1 | 7583 | 15 | 10 | 16.7 | 15 | 30 | 7.5 | 1 | 0.15 | 2 |
| 13 | 1300 | 20 | K | 0.42 | 15 | 2 | 1 | 557 | 15 | 10 | 20.5 | 15 | 30 | 7.5 | 0 | 0.122 | 34 |
| 14 | 1300 | 20 | NH3 | 0.37 | 0 | 10 | 5 | 7583 | 0 | 10 | 16.7 | 15 | 30 | 7.5 | 1 | 0.15 | 53 |
| 15 | 3000 | 20 | NH3 | 0.42 | 0 | 10 | 5 | 557 | 0 | 10 | 20.5 | 0 | 30 | 7.5 | 1 | 0.122 | 459 |
| 16 | 1300 | 15 | K | 0.42 | 0 | 2 | 1 | 7583 | 0 | 2 | 3.3 | 15 | 10 | 2.5 | 0 | 0.15 | 2 |
| 17 | 1300 | 15 | K | 0.42 | 15 | 2 | 1 | 557 | 15 | 10 | 20.5 | 0 | 10 | 2.5 | 1 | 0.122 | 5 |
| 18* | 3000 | 20 | K | 0.42 | 15 | 10 | 5 | 7607 | 0 | 10 | 5.6 | 15 | 30 | 7.5 | 0 | 0.45 | 330 |
| 19* | 1300 | 20 | NH3 | 0.42 | 15 | 2 | 1 | 7583 | 0 | 2 | 3.3 | 15 | 30 | 7.5 | 0 | 0.15 | 5.3 |
| 20 | 3000 | 20 | NH3 | 0.42 | 0 | 10 | 5 | 7607 | 0 | 10 | 5.6 | 15 | 10 | 2.5 | 0 | 0.45 | 142 |
| 21 | 3000 | 20 | NH3 | 0.42 | 15 | 10 | 5 | 7607 | 15 | 10 | 5.6 | 0 | 10 | 2.5 | 0 | 0.45 | 7 |
| 22 | 3000 | 20 | NH3 | 0.42 | 15 | 10 | 5 | 557 | 15 | 2 | 4.1 | 0 | 10 | 2.5 | 1 | 0.122 | 138 |
| 23 | 1300 | 20 | K | 0.42 | 0 | 2 | 1 | 7607 | 0 | 10 | 5.6 | 0 | 30 | 7.5 | 0 | 0.45 | 17 |
| 24 | 1300 | 20 | K | 0.42 | 0 | 10 | 5 | 7583 | 15 | 10 | 16.7 | 0 | 10 | 2.5 | 1 | 0.15 | 420 |
| 25* | 3000 | 15 | K | 0.42 | 15 | 10 | 5 | 7607 | 0 | 10 | 5.6 | 15 | 30 | 7.5 | 0 | 0.45 | 72 |
| 26 | 1300 | 15 | K | 0.42 | 0 | 10 | 5 | 557 | 0 | 10 | 20.5 | 0 | 10 | 2.5 | 0 | 0.122 | 55 |
| Sample | | | | | | | | | | | | | | | | | |
| 27 | 3000 | 20 | NH3 | 0.37 | 15 | 2 | 1 | 557 | 15 | 10 | 20.5 | 0 | 30 | 7.5 | 0 | 0.122 | 20 |
| 28 | 1300 | 20 | NH3 | 0.42 | 0 | 2 | 1 | 557 | 0 | 2 | 4.1 | 0 | 30 | 7.5 | 1 | 0.122 | 20 |
| 29 | 1300 | 15 | K | 0.42 | 15 | 10 | 5 | 7583 | 15 | 2 | 3.3 | 15 | 10 | 2.5 | 1 | 0.15 | 25 |
| 30 | 1300 | 20 | NH3 | 0.42 | 0 | 10 | 5 | 7607 | 15 | 2 | 1.1 | 15 | 30 | 7.5 | 1 | 0.45 | 57 |
| 31 | 1300 | 20 | NH3 | 0.42 | 15 | 10 | 5 | 7583 | 15 | 2 | 3.3 | 0 | 30 | 7.5 | 0 | 0.15 | 59 |
| 32 | 1300 | 15 | K | 0.42 | 0 | 10 | 5 | 557 | 0 | 10 | 20.5 | 0 | 10 | 2.5 | 0 | 0.122 | 58 |
| 33 | 3000 | 15 | K | 0.42 | 0 | 2 | 1 | 7583 | 15 | 10 | 16.7 | 15 | 30 | 7.5 | 1 | 0.15 | 1 |
| 34 | 3000 | 20 | NH3 | 0.42 | 0 | 10 | 5 | 7583 | 0 | 2 | 3.3 | 0 | 30 | 7.5 | 0 | 0.15 | 78 |
| 35 | 3000 | 20 | NH3 | 0.37 | 0 | 10 | 5 | 557 | 0 | 2 | 4.1 | 15 | 10 | 2.5 | 1 | 0.122 | 12 |
| 36 | 3000 | 15 | K | 0.42 | 15 | 10 | 5 | 7607 | 15 | 2 | 1.1 | 15 | 30 | 7.5 | 0 | 0.45 | 27 |
| 37* | 3000 | 20 | NH3 | 0.42 | 15 | 2 | 1 | 557 | 0 | 10 | 20.5 | 15 | 10 | 2.5 | 0 | 0.122 | 28 |
| 38 | 3000 | 15 | K | 0.42 | 0 | 2 | 1 | 7583 | 0 | 2 | 3.3 | 0 | 10 | 2.5 | 0 | 0.15 | 2 |
| 39* | 3000 | 15 | K | 0.42 | 15 | 2 | 1 | 7607 | 0 | 2 | 1.1 | 15 | 10 | 2.5 | 1 | 0.45 | 2 |
| 40* | 3000 | 20 | NH3 | 0.37 | 15 | 2 | 1 | 7583 | 0 | 10 | 16.7 | 0 | 30 | 7.5 | 1 | 0.15 | 2 |
| 41 | 3000 | 20 | K | 0.42 | 0 | 2 | 1 | 7607 | 15 | 2 | 1.1 | 0 | 10 | 2.5 | 1 | 0.45 | 5 |
| 42* | 3000 | 15 | K | 0.42 | 15 | 2 | 1 | 7583 | 0 | 2 | 3.3 | 0 | 30 | 7.5 | 0 | 0.15 | 2 |

TABLE 1-continued

| | | | | | | | | | | | | | | | | | |
|---|---|---|---|---|---|---|---|---|---|---|---|---|---|---|---|---|---|
| 43* | 1300 | 20 | NH3 | 0.37 | 15 | 2 | 1 | 7607 | 0 | 2 | 1.1 | 0 | 10 | 2.5 | 1 | 0.45 | 2.4 |
| 44 | 3000 | 20 | NH3 | 0.42 | 15 | 2 | 1 | 7607 | 15 | 10 | 5.6 | 15 | 10 | 2.5 | 1 | 0.45 | 10 |
| 45* | 3000 | 20 | NH3 | 0.37 | 15 | 10 | 5 | 557 | 0 | 2 | 4.1 | 15 | 30 | 7.5 | 1 | 0.122 | 52 |
| 46 | 1300 | 20 | NH3 | 0.42 | 0 | 2 | 1 | 557 | 0 | 2 | 4.1 | 0 | 30 | 7.5 | 1 | 0.122 | 1.9 |
| 47 | 1300 | 15 | K | 0.42 | 0 | 2 | 1 | 7607 | 15 | 10 | 5.6 | 15 | 10 | 2.5 | 0 | 0.45 | 5 |
| 48* | 1300 | 20 | NH3 | 0.37 | 15 | 10 | 5 | 7583 | 0 | 10 | 16.7 | 15 | 10 | 2.5 | 1 | 0.15 | 214 |
| 49 | 1300 | 20 | NH3 | 0.37 | 0 | 2 | 1 | 7607 | 15 | 2 | 1.1 | 0 | 30 | 7.5 | 0 | 0.45 | 4 |
| 50 | 1300 | 15 | K | 0.42 | 15 | 10 | 5 | 7607 | 15 | 10 | 5.6 | 0 | 30 | 7.5 | 1 | 0.45 | 119 |
| 51 | 1300 | 20 | K | 0.42 | 15 | 2 | 1 | 7583 | 15 | 10 | 16.7 | 15 | 30 | 7.5 | 0 | 0.15 | 2 |
| 52 | 1300 | 20 | NH3 | 0.37 | 0 | 10 | 5 | 557 | 15 | 2 | 4.1 | 0 | 10 | 2.5 | 0 | 0.122 | 33 |
| 53 | 3000 | 20 | NH3 | 0.37 | 15 | 2 | 1 | 7583 | 15 | 2 | 3.3 | 15 | 10 | 2.5 | 0 | 0.15 | 2 |
| 54* | 1300 | 20 | NH3 | 0.42 | 15 | 10 | 5 | 7607 | 0 | 2 | 1.1 | 0 | 30 | 7.5 | 1 | 0.45 | 58 |
| 55 | 1300 | 20 | NH3 | 0.42 | 0 | 2 | 1 | 557 | 15 | 2 | 4.1 | 15 | 10 | 2.5 | 1 | 0.122 | — |
| 56* | 1300 | 20 | K | 0.42 | 15 | 2 | 1 | 7607 | 0 | 2 | 1.1 | 0 | 10 | 2.5 | 1 | 0.45 | 5.7 |
| 57 | 1300 | 15 | K | 0.42 | 0 | 10 | 5 | 557 | 15 | 2 | 4.1 | 15 | 30 | 7.5 | 1 | 0.122 | 6 |
| 58 | 1300 | 20 | NH3 | 0.42 | 0 | 2 | 1 | 557 | 15 | 2 | 4.1 | 15 | 10 | 2.5 | 1 | 0.122 | 1 |
| 59 | 1300 | 20 | NH3 | 0.37 | 15 | 10 | 5 | 7583 | 15 | 2 | 3.3 | 0 | 30 | 7.5 | 0 | 0.15 | 65 |
| 60 | 1300 | 20 | NH3 | 0.37 | 0 | 2 | 1 | 7607 | 0 | 2 | 1.1 | 15 | 10 | 2.5 | 0 | 0.45 | 3 |
| 61 | 3000 | 20 | K | 0.42 | 0 | 2 | 1 | 7583 | 0 | 10 | 16.7 | 0 | 10 | 2.5 | 1 | 0.15 | 1.9 |
| 62 | 3000 | 20 | K | 0.42 | 0 | 10 | 5 | 557 | 15 | 2 | 4.1 | 15 | 10 | 2.5 | 0 | 0.122 | 5.6 |
| 63 | 3000 | 20 | K | 0.42 | 15 | 10 | 5 | 7583 | 15 | 2 | 3.3 | 0 | 10 | 2.5 | 1 | 0.15 | 43 |
| 64* | 1300 | 20 | NH3 | 0.37 | 15 | 10 | 5 | 7583 | 0 | 10 | 16.7 | 15 | 10 | 2.5 | 1 | 0.15 | 107 |
| 65 | 1300 | 15 | K | 0.42 | 15 | 2 | 1 | 557 | 15 | 10 | 20.5 | 0 | 10 | 2.5 | 1 | 0.122 | 21 |
| 66 | 3000 | 15 | K | 0.42 | 0 | 2 | 1 | 7583 | 0 | 2 | 3.3 | 0 | 10 | 2.5 | 0 | 0.15 | 2 |
| 67 | 3000 | 15 | K | 0.42 | 0 | 2 | 1 | 7583 | 15 | 10 | 16.7 | 15 | 30 | 7.5 | 1 | 0.15 | 2 |
| 68* | 1300 | 15 | K | 0.42 | 15 | 2 | 1 | 557 | 0 | 10 | 20.5 | 0 | 10 | 2.5 | 0 | 0.122 | 5 |

*Denotes that the Example is considered an embodiment of the present invention; that is, the Example is of the Series Three grouping.

| | | | |
|---|---|---|---|
| % solids Kymene 557 | 0.122 1 meq/g | All EAA's are tagged at 1 Ru tris bipyridine/1000 AA's | |
| % solids Nalco 7583 | 0.15 6 meq/g | Wt of furnish (g) | 5 |
| % solids Nalco 7607 | 0.45 6 meq/g | % solids EAA | 0.5 |
| % solids Flocculant (Nalco 7523) | 0.125 | % solids Cationic starch (Solvatose N) | 1 |

Flocculant (25% actives, 0.5 ml) always added at 30 seconds = 0.25 lb/ton. (Material to mold at 75 sec)
Microparticulate (1 lb/ton actives) added at 45 seconds (0.1% actives, 2 ml)

TABLE 2

| Early = 0<br>Late = 15 | First Series:<br>EAA & Retention Aid<br>Added Together and Early | Second Series:<br>EAA Added Before<br>Retention Aid | Third Series:<br>EM Added After<br>Retention Aid | Fourth Series:<br>EM & Retention Aid<br>Added Together and Late |
|---|---|---|---|---|
| | 1.9 | 3 | 107 | 84 |
| | 69 | 395 | 14 | 5 |
| | 459 | 420 | 2 | 5 |
| | 17 | 5 | 2 | 7 |
| | 55 | 4 | 2.4 | 138 |
| | 20 | 33 | 58 | 20 |
| | 58 | 4 | 5.7 | 59 |
| | 78 | 2 | 5 | 119 |
| | 2 | 57 | 16 | 65 |
| | 1.9 | 1 | 330 | 43 |
| | 2 | 5 | 5.3 | 21 |
| | 11 | 1 | 72 | 137 |
| | 53 | 6 | 28 | 34 |
| | 2 | 1 | 2 | 25 |
| | 142 | 5.6 | 52 | 27 |
| | 12 | 2 | 519 | 10 |
| | 3 | | 214 | 2 |
| | | | | 2 |
| Total | 987 | 945 | 1434 | 803 |
| Count | 17 | 16 | 17 | 18 |
| Average HST | 58 | 59 | 84 | 45 |

In another evaluation, a paper making process 20 (FIG. 2) comprising a stock chest or stuff box 30, a first mixing tank, beater or hydropulper 40 equipped with overflow baffling 41 and downstream of the stock chest or stuff box 30; a second mixing tank, beater or hydropulper 50 equipped with overflow baffling 51 and downstream of the first mixing tank, beater or hydropulper 40; conduit 60 extending between the second mixing tank, beater or hydropulper 50 and a fan pump 70 downstream of the second mixing tank, beater or hydropulper 50; and additional conduit 65 extending between the fan pump 70 and a headbox or flowbox 80 downstream of the fan pump 70 was utilized to investigate the result of employing different sizing agents, retention aids and addition times/points. Four different retention aids or coagulants were employed, including a cationic starch, and two different aqueous EAA dispersions at 45 percent solids were employed in the evaluation. The retention aids are shown in Table 3 and include XD1947 which was prepared as a reaction product of an amine and epichlorohydrin in accordance with methods and procedures described by Vaughn et al. in U.S. Pat. No. 4,181,566. The aqueous dispersions were made in the one gallon Parr reactor described above using two different resins, the 20% AA, 1300 MI EAA resin described above and a 20% AA, 300 MI EAA resin available from The Dow Chemical Company under the designation PRIMACORT™ 5980. To prepare the sizing agent for Examples 69–72, a sufficient amount of resin to provide a 45 percent solids dispersion was added to a 1.5:0.1:1.0 mole ratio of potassium to ammonia to acrylic acid aqueous solution under agitation in the Parr reactor. To prepare the sizing agent for Examples 73–78, a sufficient amount of resin to provide a 25 percent solids dispersion was added to a 0.42 mole ratio of ammonia to acrylic acid aqueous solution under agitation in the Parr reactor. The potassium cation was provided by a potassium hydroxide solution and the ammonia cation was provided by an ammonium hydroxide solution. Reactor agitation was provided by a magnetically coupled stirrer with two six blade (45° pitched) impellers set at 300 revolutions per minute. A Watlow temperature controller ramped the temperature of the reactor from ambient to 120° C. in 30 minutes, maintained the temperature at 120° C. for two hours, then cooled the reactor to ambient temperature. To confirm that the reactor integrity remained intact during the run, the system was pressured with 20 pounds per square inch gauge (psig) of nitrogen at the beginning of the run. After the run was completed, the reactor pressure was checked to confirm that it had returned to the original setting. The resulting EAA dispersions were diluted to 6 percent solids concentrations and added to the process as an internal sizing agent according to the Addition Positions specified in Table 4 at a size basis weight of about 10 lbs. per ton of pulp.

With reference to FIG. 2, Addition Point One was the mixing area 42 of the first mixing tank, beater or hydropulper 40. For this evaluation, with its given flow, to Addition Point One was located about 39 seconds upstream of (or before) the headbox or flowbox 80. Addition Point Two was the overflow area 43 of the first mixing tank, beater or hydropulper 40. Addition Point Three was the mixing area 52 of the second mixing tank, beater or hydropulper 50. For this evaluation, with its given flow rate, Addition Point Three was located about 26 seconds upstream of (or before) the headbox or flowbox 80. Addition Point Four was the overflow area 53 of the second mixing tank, beater or hydropulper 50. Addition Point Five was at or into the conduit 60 and Addition Point Six was at or into conduit 65. Unfilled, bleached 70/30 hard to soft wood pulp was utilized as the fiber stock. The process was ran at about 1–5 gallons per minute through the stock chest or stuff box 30, at about 20 gallons per minute from the stock chest or stuff box 30 to the fan pump 70 and at about 80–100 gallons per minute from the fan pump 70 to the headbox or flowbox 80. The process provided about 40 lbs. per ream (or about 160 pounds per hour) of sized paper. Table 3 further describes the various runs in this evaluation and shows the resulting HST performance data.

TABLE 3

| Example | First Retention Aid & Basis Weight | First Retention Aid Addition Point | EAA Sizing Agent Addition Point | Second Retention Aid or Coagulant & Basis Weight | Second Retention Aid or Coagulant Addition Point | HST Value |
|---|---|---|---|---|---|---|
| 69 | Kymene 557 3 lbs./ton | One | Two | Percol 292 0.6 lbs./ton | Six | 162 |
| 70 | Kymene 557 3 lbs./ton | One | Three | Percol 292 0.6 lbs./ton | Six | 141 |
| 71 | Kymene 557 3 lbs./ton | One | Five | Percol 292 0.6 lbs./ton | Six | 86 |
| 72 | Kymene 557 3 lbs./ton | Four | Five | Percol 292 0.6 lbs./ton | Six | 32 |
| 73 | Kymene 557 14.75 lbs./ton | One | Two | Percol 292 0.6 lbs./ton | Five | 778 |
| 74 | Kymene 557 14.75 lbs./ton | One | Two + Stalock 400 at 16 lbs/ton | Percol 292 0.6 lbs./ton | Five | 1,421 |
| 75 | Reten 201 14.75 lbs./ton | One | Two | Percol 292 0.6 lbs./ton | Five | 822 |
| 76 | Reten 201 14.75 lbs./ton | One | Two + Stalock 400 at 16 lbs/ton | Percol 292 0.6 lbs./ton | Five | 1,086 |
| 77 | XD1947 17 lbs./ton | One | Two | Percol 292 0.6 lbs./ton | Five | 1 |
| 78 | XD1947 17 lbs./ton | One | Two + Stalock 400 at 16 lbs/ton | Percol 292 0.6 lbs./ton | Five | ~1,000 |

Results disclosed in Table 3 indicate that a mixed base dispersion is an excellent internal sizing agent for paper. That is, for a paper making process in accordance with the present invention where a sizing agent is introduced after the introduction of a first retention (and the earlier in the process, the better), good HST values are obtainable. Excellent HST values are obtainable at higher basis weight amounts for a first retention aid and additional enhancements can be achieved with the use of a cationic starch derivative material such as, for example, Stalock 400.

In another evaluation, precipitation resistance on dilution with hard water was investigated for 35 percent solids aqueous dispersions based on organic and inorganic cations. The investigation involved a simple titration procedure wherein a 1 weight percent solution of $CaCl_2$ was used to simulate hard water and the dispersion were diluted and titrated at 0.7 percent solids. Table 4 provides the description of the dispersions and the titration results (i.e., precipitation resistance).

TABLE 4

| | | |
|---|---|---|
| grams of solution | 500 | |
| grams of dispersion | 10 | |
| grams of resin | 3.5 | |
| grams of AA | 0.7 | |
| moles of AA | 0.00972 | |
| | $NH_4OH$ | KOH |
| grams of hard water | 38.78 | 47.87 |
| grams of $CaCl_2$ | 0.3878 | 0.4787 |
| grams of Ca | 0.141 | 0.17406 |
| moles of Ca | 0.00353 | 0.00435 |
| moles of Ca to precipitate 1 mole of AA | 0.36258 | 0.44757 |

The titration results in Table 4 show ammonium hydroxide dispersion (organic) consumed about 38.78 grams of hard water before precipitating and the potassium hydroxide dispersion (inorganic cation) consumed about 47.87 grams of $CaCl_2$ before precipitating. These results indicate, surprisingly, aqueous dispersions based on inorganic cationic neutralizing materials are have superior resistance to hard water, even ordinary tap water, relative to comparable aqueous dispersions based on organic cationic neutralizing materials. These results are considered surprising in that, without the benefit of the present invention, one of skill in the art would have generally believed that hard water dilutions inherently caused the solid polymer dispersions to prematurely precipitate due to unfavorable ion exchange interactions and such premature precipitation could only be prevented by pre-conditioning or softening the process water. Given these results, one of the advantages of the present invention is now practitioners who desire to size cellulosic articles can do so without the need to pre-condition or soften the process water used in the paper making process.

What is claimed is:

1. A process for internally sizing a cellulosic article, wherein at least one internal sizing agent, at least one first retention aid and at least one second retention aid are applied to the fibers of the cellulosic article, and wherein the internal sizing agent is a water-dispersible, water- and alkali-insoluble reaction product of (a) at least one neutralizing cationic compound, and (b) at least one interpolymer of an ethylenically unsaturated hydrocarbon monomer and at least one ethylenically unsaturated carboxylic acid comonomer, and wherein the process is characterized as having a flow, a first addition point and at least one other addition point upstream of the first addition point and comprises adding the at least one retention aid at the first addition point, adding the at least one internal sizing agent at the at least one other addition point at a time equal to or greater than 10 seconds after the addition of the at least one retention aid and adding the at least one second retention aid simultaneously with or after the addition of the at least one internal sizing agent.

2. The method of claim 1 wherein the interpolymer comprises ethylene and acrylic acid.

3. The method of claim 2 wherein the interpolymer is a copolymer of ethylene and acrylic acid.

4. The method of claim 3 wherein the acrylic acid content of the copolymer is from about 10 to about 25 weight percent.

5. The method of claim 1 wherein the cellulosic article is paper.

6. The method of claim 1 wherein the at least one cation neutralizing compound is selected from the group consisting of aqueous ammonia, alkali metal hydroxide, and alkaline earth metal hydroxide.

7. The method of claim 6 wherein the cation neutralizing compound is an aqueous ammonium hydroxide solution.

8. The method of claim 1 wherein the interpolymer is rendered water-dispersible by employing at least one inorganic cation neutralizing material.

9. The method of claim 8 wherein the inorganic cation neutralizing material is an aqueous potassium hydroxide solution.

10. The method of claim 8 wherein the inorganic cation neutralizing material is an aqueous sodium hydroxide solution.

11. The method of claim 1 wherein the cation neutralizing material is an aqueous potassium hydroxide solution.

12. The method of claim 1 wherein the interpolymer is rendered water-dispersible by employing a mixture of at least two cation neutralizing materials each selected from the group consisting of aqueous ammonia, alkali metal hydroxide, and alkaline earth metal hydroxide.

13. The process of claim 1 wherein the process is a papermaking process.

14. The process of claim 13 wherein the papermaking process has a sizing production rate capability of 160 pounds per hour of sized paper.

15. A process for internally sizing a cellulosic article, wherein at least one internal sizing agent, at least one first retention aid and at least one second retention aid are applied to the fibers of the cellulosic article, and wherein the internal sizing agent is a water-dispersible, water- and alkali-insoluble reaction product of (a) at least one neutralizing cationic compound, and (b) at least one interpolymer of an ethylenically unsaturated hydrocarbon monomer and at least one ethylenically unsaturated carboxylic acid comonomer, and wherein the process is characterized as having a flow, a first addition point and at least one other addition point upstream of the first addition point and comprises adding the at least one retention aid at the first addition point, the at least one sizing agent is added at a time between 0.1 seconds and 15 seconds after the introduction of the first retention aid and the at least one second retention aid is added simultaneously with or after the addition of the at least one sizing agent.

* * * * *